US007183975B2

(12) United States Patent
Thomas et al.

(10) Patent No.: US 7,183,975 B2
(45) Date of Patent: Feb. 27, 2007

(54) ATTACHING ANTENNA STRUCTURES TO ELECTRICAL FEED STRUCTURES

(75) Inventors: Rebecca Thomas, Cambridge (GB); Susan Williams, Cambridge (GB); James William Kingsley, Cambridge (GB)

(73) Assignee: Antenova Ltd., Cambridge (GB)

( * ) Notice: Subject to any disclaimer, the term of this patent is extended or adjusted under 35 U.S.C. 154(b) by 26 days.

(21) Appl. No.: 10/514,108

(22) PCT Filed: May 15, 2003

(86) PCT No.: PCT/GB03/02114

§ 371 (c)(1),
(2), (4) Date: Nov. 12, 2004

(87) PCT Pub. No.: WO03/098737

PCT Pub. Date: Nov. 27, 2003

(65) Prior Publication Data

US 2005/0162316 A1 Jul. 28, 2005

(30) Foreign Application Priority Data

May 15, 2002 (GB) ..... 0211109.4
May 15, 2002 (GB) ..... 0211114.4

(51) Int. Cl.
*H01Q 1/38* (2006.01)

(52) U.S. Cl. ..... 343/700 MS; 343/795; 343/702; 343/793; 343/846

(58) Field of Classification Search ..... 343/795, 343/700 MS
See application file for complete search history.

(56) References Cited

U.S. PATENT DOCUMENTS 4,755,820 A * 7/1988 Backhouse et al. .. 343/700 MS
4,980,694 A * 12/1990 Hines ..... 343/702
5,233,273 A * 8/1993 Waki et al. ..... 315/224
5,453,754 A 9/1995 Fray (Continued)

FOREIGN PATENT DOCUMENTS

EP 0217426 4/1987

(Continued)

OTHER PUBLICATIONS

U.S. Appl. No. 09/431,548, Kingsley et al.

(Continued)

*Primary Examiner*—Wilson Lee
*Assistant Examiner*—Binh Van Ho
(74) *Attorney, Agent, or Firm*—Pearl Cohen Zedek Latzer, LLP

(57) ABSTRACT

There is disclosed a dielectric antenna comprising a dielectric resonator mounted in direct contact with a microstrip transmission line formed on one side of a printed circuit board. The dielectric antenna may be a dielectric resonator antenna (DRA), a high dielectric antenna (HDA) or a dielectrically-loaded antenna. The simple construction of the antenna leads to improved manufacturing reliability and efficiency, and allows all functional features of the antenna to be located on one side of a printed circuit board (PCB) substrate.

25 Claims, 4 Drawing Sheets

U.S. PATENT DOCUMENTS

| | | | | |
|---|---|---|---|---|
| 5,399,944 | A * | 3/1995 | Konopka et al. | 315/219 |
| 5,541,616 | A | 7/1996 | Kawahata et al. | |
| 5,581,262 | A | 12/1996 | Kawahata et al. | |
| 5,952,972 | A * | 9/1999 | Ittipiboon et al. | 343/700 MS |
| 5,998,939 | A * | 12/1999 | Fellows et al. | 315/246 |
| 6,002,210 | A * | 12/1999 | Nilssen | 315/219 |
| 6,031,503 | A * | 2/2000 | Preiss et al. | 343/770 |
| 6,104,349 | A | 8/2000 | Cohen | |
| 6,184,833 | B1 * | 2/2001 | Tran | 343/700 MS |
| 6,198,450 | B1 | 3/2001 | Adachi et al. | |
| 6,323,824 | B1 | 11/2001 | Heinrichs et al. | |
| 6,333,719 | B1 * | 12/2001 | Varadan et al. | 343/787 |
| 6,337,666 | B1 * | 1/2002 | Bishop | 343/795 |
| 6,384,785 | B1 | 5/2002 | Kamogawa et al. | |
| 6,452,565 | B1 | 9/2002 | Kingsley et al. | |
| 6,683,418 | B2 * | 1/2004 | Shoji et al. | 315/224 |
| 6,801,164 | B2 * | 10/2004 | Bit-Babik et al. | 343/700 MS |
| 6,819,287 | B2 * | 11/2004 | Sullivan et al. | 343/700 MS |
| 2001/0054978 | A1 | 12/2001 | Adachi et al. | |
| 2002/0000938 | A1 | 1/2002 | Hoashi et al. | |
| 2002/0101382 | A1 | 8/2002 | Konishi et al. | |
| 2005/0225499 | A1 | 10/2005 | Kingsley et al. | |
| 2005/0242996 | A1 * | 11/2005 | Palmer et al. | 343/700 MS |

FOREIGN PATENT DOCUMENTS

| | | |
|---|---|---|
| EP | 0762539 | 3/1997 |
| EP | 0767510 | 4/1997 |
| EP | 0801436 | 10/1997 |
| EP | 0 801 436 | 2/2000 |
| EP | 0801436 | 2/2000 |
| EP | 0982799 | 3/2000 |
| GB | 2 046 530 | 11/1980 |
| GB | 2046530 | 11/1980 |
| GB | 084877 | 6/1981 |
| GB | 2268626 | 1/1984 |
| GB | 2 360 133 | 9/2001 |
| GB | 2 377 556 | 1/2003 |
| GB | 2 386 475 | 9/2003 |
| GB | 2393039 | 3/2004 |
| JP | 01144801 | 6/1989 |
| JP | 2257702 | 10/1990 |
| JP | 07249927 | 9/1995 |
| JP | 091723061 | 6/1997 |
| JP | 10163738 | 6/1998 |

OTHER PUBLICATIONS

U.S. Appl. No. 09/172,306, filed Jun. 30, 1997, Kenichi.

Leung K W, et al. Low Profile Circular Disk DR Antenna of Very High Permittivity Excited By a Microstipline Electronics Letters, IEE Stevenage, GB, vol. 33 No. 12, Jun. 5, 1997, pp. 1004-1005 XP0067576. Issn: 0013-5194 Figure 1.

Luk K M, et al "Technique for Improving Coupling Between Microstripline and Dielectric Resonator Antenna." Electronics Letters, IEE Stevenage, GB, vol. 35, No. 5, Mar. 4, 1999, pp. 357-358, XP006011858 Issn: 0013-5194 Figure 2.

Petosa, A Ittipiboon, A., Antar, Y M.M , Roscoe, D. and Cuhaci, M : "Recent Advances in Dielectric-Resonator Antenna Technology" IEEE Antennas and Propagation Magazine, 1998, 40, (3), pp. 35-48.

Leung, K.W : Simple Results for Conformal-Strip Excited Hemispherical Dielectric Resonator Antenna Electronics Letters 2000, 36, (11).

Tam, M T K and Murch, R D : "Half Volume Dielectric Resonator Antenna Designs", Electronics Letters, 1997, 33, (23), pp. 1914-1916.

Ittipiboon, A., Mongia, R.K., Antar, Y.M.M., Bhartia, P. and Cuhaci, M.: "Aperture Fed Rectangular and Triangular Dielectric Resonators for use as Magnetic Dipole Antennas", Electronics Letters, 1993, 29, (23), pp. 2001-2002.

Kingsley, S.P. and O'Keefe, S.G., "Beam steering and monopulse processing of probe-fed dielectric resonator antennas", IEE Proceedings—Radar Sonar and Navigation, 146, 3, 121-125, 1999.

Long, S.A., McAllister, M.W., and Shen, L.C.: "The Resonant Cylindrical Dielectric Cavity Antenna", IEEE Transactions on Antennas and Propagation, AP-31, 1983, pp. 406-412.

McAllister, M.W., Long, S.A. and Conway G.L.: "Rectangular Dielectric Resonator Antenna", Electronics Letters, 1983, 19, (6), pp. 218-219.

Mongia, R.K. and Bhartia, P.: "Dielectric Resonator Antennas—A Review and General Design Relations for Resonant Frequency and Bandwidth", International Journal of Microwave and Millimetre-Wave Computer-Aided Engineering, 1994, 4, (3), pp. 230-247.

Mongia, R.K., Ittipiboon, A., Antar, Y.M.M., Bhartia, P. and Cuhaci, M: "A Half-Split Cylindrical Dielectric Resonator Antenna Using Slot-Coupling", IEEE Microwave and guided Wave Letters, 1993, vol. 3, No. 2, pp. 38-39.

Petosa A, et al. "Bandwith Improvement for a microstrip-fed series array of dielectric resonator antennas." Electronics Letters, IEE Stevenage, GB, vol. 32, No. 7, Mar. 28, 1996, pp. 608-609, XP006004963. Issn: 0013-5194. Figure 1.

U.S. Appl. No. 09/431,548, filed Oct. 29, 1999, Kingsley et al.

Leung, K.W., et al. "Annular Slot-Coupled Dielectric Resonator Antenna," Electronic Letters, Jun. 25, 1998, vol. 34, No. 13.

Leung, K.W., et al. "Low-Profile Circular Disk DR Antenna of Very High Permittivity Excited by a Microstripline," Electronic Letters, Jun. 5, 1997, vol. 33, No. 12.

Leung, K.W. "Simple Result for Conformal-strip Excited Hemispherical Dielectric Resonator Antenna," Electronics Letters, May 25, 2000, vol. 36, No. 11.

Luk, K.M., et al. "Technique for Improving Coupling Between Microstripline and Dielectric Resonator Antenna," Electronics Letters Mar. 4, 1999, vol. 35, No. 5.

Guo, Y.X., et al. "Mutual Coupling Between Rectangular Dielectric Resonator Antennas by FDTD," IEE Proc.-Microw. Antennas Propag., vol. 146, No. 4, Aug. 1999.

Office Action dated Feb. 1, 2006 U.S. Appl. No. 10/524,488.

Ittipiboon, A., Mongia, R.K., Antar, Y.M.M., Bhartia, P. and Cuhaci, M.: "Aperture Fed Rectangular and Triangular Dielectric Resonators for use as Magnetic Dipole Antennas", Electronics Letters, 1993, 29, (23), pp. 2001-2002.

Kingsley, S.P. and O'Keefe, S.G., "Beam steering and monopulse processing of probe-fed dielectric resonator antennas", IEE Proceedings—Radar Sonar and Navigation, 146, 3, 121-125, 1999.

Leung, K.W.: "Simple results for conformal-strip excited hemispherical dielectrical resonator antenna", Electronics Letters, 2000, 36, (11).

Long, S.A., McAllister, M.W., and Shen, L.C.: "The Resonant Cylindrical Dielectric Cavity Antenna", IEEE Transactions on Antennas and Propagation, AP-31, 1983, pp. 406-412.

McAllister, M.W., Long, S.A. and Conway G.L.: "Rectangular Dielectric Resonator Antenna", Electronics Letters, 1983, 19, (6), pp. 218-219.

Mongia, R.K. and Bhartia, P.: "Dielectric Resonator Antennas—A Review and General Design Relations for Resonant Frequency and Bandwidth", International Journal of Microwave and Millimetre-Wave Computer-Aided Engineering, 1994, 4, (3), pp. 230-247.

Mongia, R.K., Ittipiboon, A., Antar, Y.M.M., Bhartia, P. and Cuhaci, M: "A Half-Split Cylindrical Dielectric Resonator Antenna Using Slot-Coupling", IEEE Microwave and guided Wave Letters, 1993, vol. 3, No. 2, pp. 38-39.

Petosa, A., Ittipiboon, A., Antar, Y.M.M., Roscoe, D., and Cuhaci, M.: "Recent advances in Dielectric-Resonator Antenna Technology", IEEE Antennas and Propagation Magazine, 1998, 40, (3), pp. 35-48.

Tam, M.T.K. and Murch, R.D.: "Half volume dielectric resonator antenna designs", Electronics Letters, 1997, 33, (23), pp. 1914-1916.

International Search Report for International Application No. PCT/GB 03/03546, dated Dec. 29, 2003.

Combined Search and Examination report for application No. GB 0415923.2 dated Aug. 24, 2004.

* cited by examiner

ATTACHING ANTENNA STRUCTURES TO ELECTRICAL FEED STRUCTURES

PRIOR APPLICATION DATA

The present application is a national phase application of International Application PCT/GB2003/002114, entitled "Improvements Relating to Attaching Dielectric Resonator Antennas to Microstrip Lines" filed on May 15, 2003, which in turn claims priority from application GB 0211109.4, filed on May 15, 2002 and GB 0211114.4, filed on May 15, 2002, all of which are incorporated by reference in their entirety.

FIELD OF THE INVENTION

The present invention relates to techniques for attaching antenna structures, including but not limited to dielectric resonators or pellets, to electrical feed structures so as to form antennas, for example dielectric resonator antennas (DRAs), high dielectric antennas (HDAs) and dielectrically-loaded antennas (DLAs).

BACKGROUND OF THE INVENTION

Dielectric resonator antennas are resonant antenna devices that radiate or receive radio waves at a chosen frequency of transmission and reception, as used in for example in mobile telecommunications. In general, a DRA consists of a volume of a dielectric material (the dielectric resonator or pellet) disposed on or close to a grounded substrate, with energy being transferred to and from the dielectric material by way of monopole probes inserted into the dielectric material or by way of monopole aperture feeds provided in the grounded substrate (an aperture feed is a discontinuity, generally rectangular in shape, although oval, oblong, trapezoidal or butterfly/bow tie shapes and combinations of these shapes may also be appropriate, provided in the grounded substrate where this is covered by the dielectric material. The aperture feed may be excited by a strip feed in the form of a microstrip transmission line, coplanar waveguide, slotline or the like which is located on a side of the grounded substrate remote from the dielectric material). Direct connection to and excitation by a microstrip transmission line is also possible. Alternatively, dipole probes may be inserted into the dielectric material, in which case a grounded substrate is not required. By providing multiple feeds and exciting these sequentially or in various combinations, a continuously or incrementally steerable beam or beams may be formed, as discussed for example in the present applicant's co-pending U.S. patent application Ser. No. 09/431,548 and the publication by KINGSLEY, S. P. and O'KEEFE, S. G., "Beam steering and monopulse processing of probe-fed dielectric resonator antennas", IEEE Proceedings—Radar Sonar and Navigation, 146, 3, 121–125, 1999, the full contents of which are hereby incorporated into the present application by reference.

The resonant characteristics of a DRA depend, inter alia, upon the shape and size of the volume of dielectric material and also on the shape, size and position of the feeds thereto. It is to be appreciated that in a DRA, it is the dielectric material that resonates when excited by the feed. This is to be contrasted with a dielectrically loaded antenna, in which a traditional conductive radiating element is encased in a dielectric material that modifies the resonance characteristics of the radiating element.

DRAs may take various forms, a common form having a cylindrical shape dielectric pellet which may be fed by a metallic probe within the cylinder. Such a cylindrical resonating medium can be made from several candidate materials including ceramic dielectrics.

Since the first systematic study of dielectric resonator antennas (DRAs) in 1983 [LONG, S. A., McALLISTER, M. W., and SHEN, L. C.: "The Resonant Cylindrical Dielectric Cavity Antenna", IEEE Transactions on Antennas and Propagation, AP-31, 1983, pp 406–412], interest has grown in their radiation patterns because of their high radiation efficiency, good match to most commonly used transmission lines and small physical size [MONGIA, R. K. and BHARTIA, P.: "Dielectric Resonator Antennas—A Review and General Design Relations for Resonant Frequency and Bandwidth", International Journal of Microwave and Millimetre-Wave Computer-Aided Engineering, 1994, 4,(3), pp 230–247]. A summary of some more recent developments can be found in PETOSA, A., ITTIPIBOON, A., ANTAR, Y. M. M., ROSCOE, D., and CUHACI, M.: "Recent advances in Dielectric-Resonator Antenna Technology", IEEE Antennas and Propagation Magazine, 1998, 40, (3), pp 35–48.

A variety of basic shapes have been found to act as good DRA resonator structures when mounted on or close to a ground plane (grounded substrate) and excited by an appropriate method. Perhaps the best known of these geometries are:

Rectangle [McALLISTER, M. W., LONG, S. A. and CONWAY G. L.: "Rectangular Dielectric Resonator Antenna", Electronics Letters, 1983, 19, (6), pp 218–219].

Triangle [ITTIPIBOON, A., MONGIA, R. K., ANTAR, Y. M. M., BHARTIA, P. and CUHACI, M.: "Aperture Fed Rectangular and Triangular Dielectric Resonators for use as Magnetic Dipole Antennas", Electronics Letters, 1993, 29, (23), pp 2001–2002].

Hemisphere [LEUNG, K. W.: "Simple results for conformal-strip excited hemispherical dielectric resonator antenna", Electronics Letters, 2000, 36, (11)].

Cylinder [LONG, S. A., McALLISTER, M. W., and SHEN, L. C.: "The Resonant Cylindrical Dielectric Cavity Antenna", IEEE Transactions on Antennas and Propagation, AP-31, 1983, pp 406–412].

Half-split cylinder (half a cylinder mounted vertically on a ground plane) [MONGIA, R. K., ITTIPIBOON, A., ANTAR, Y. M. M., BHARTIA, P. and CUHACI, M: "A Half-Split Cylindrical Dielectric Resonator Antenna Using Slot-Coupling", IEEE Microwave and guided Wave Letters, 1993, Vol. 3, No. 2, pp 38–39].

Some of these antenna designs have also been divided into sectors. For example, a cylindrical DRA can be halved [TAM, M. T. K. and MURCH, R. D.: "Half volume dielectric resonator antenna designs", Electronics Letters, 1997, 33, (23), pp 1914–1916]. However, dividing an antenna in half, or sectorising it further, does not change the basic geometry from cylindrical, rectangular, etc.

High dielectric antennas (HDAs) are similar to DRAs, but instead of having a full ground plane located under the dielectric pellet, HDAs have a smaller ground plane or no ground plane at all. Removal of the ground plane underneath gives a less well-defined resonance and consequently a very much broader bandwidth. HDAs generally radiate as much power in a backward direction as they do in a forward direction.

In both DRAs and HDAs, the primary radiator is the dielectric pellet. In DLAs, the primary radiator is a conductive component (e.g. a metal wire or printed strip or the like), and a dielectric component then just modifies the medium in which the DLA operates and generally allows the antenna as a whole to be made smaller or more compact.

BRIEF DESCRIPTION OF THE DRAWINGS

For a better understanding of the present invention and to show how it may be carried into effect, reference shall now be made by way of example to the accompanying drawings, in which.

DETAILED DESCRIPTION OF THE INVENTION

Figure 1:
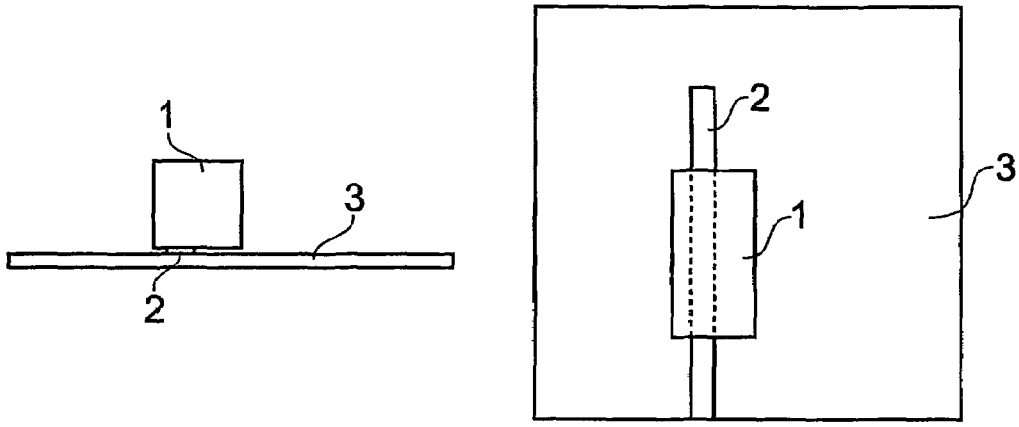
FIG. 1 shows side and plan views of a rectangular ceramic pellet mounted on a direct microstrip transmission line on one side of a PCB.

A DLA may also be excited or formed by a direct microstrip feedline. In particular, the present applicant has found that a pellet of dielectric material may be placed on or otherwise associated with a microstrip feedline or the like so as to modify radiation properties of the feedline when operating as an antenna.

The present application is particularly but not exclusively directed towards techniques for constructing DRAs, HDAs and DLAs by way of assembly-line processes in a large-scale industrial context. Furthermore, the present application is particularly but not exclusively concerned with DRAs or HDAs comprised as a piece of high dielectric constant ceramic material excited by some form of feed structure on a printed circuit board (PCB), and also with DLAs comprising a conductive radiator provided with a pellet of dielectric material.

For the purposes of the present application, the expression "dielectric antenna" is hereby defined as encompassing DRAs, HDAs and DLAs.

According to a first aspect of the present invention, there is provided a dielectric antenna comprising a dielectric pellet mounted in direct contact with a microstrip transmission line formed on one side of a dielectric substrate.

According to a second aspect of the present invention, there is provided a method of manufacturing a dielectric antenna, wherein a dielectric pellet is mounted in direct contact with a microstrip transmission line formed on one side of a dielectric substrate.

The dielectric substrate may be in the form of a printed circuit board (PCB) and may have optional metallisation on at least part of one or other of its major surfaces.

In preferred embodiments, the dielectric pellet is made of a ceramic material, preferably with a high dielectric constant.

The dielectric antenna may be a DRA, an HDA or a DLA.

This has the advantage of making an antenna with good gain and bandwidth and a very simple method of assembly because everything is on one side of the dielectric substrate or PCB (with slot feeding, for example, the microstrip is on one side of the board and the ceramic pellet is on the other). On a production line, a pick-and-place machine can take ceramic pellets supplied on a reel and place these directly onto the dielectric substrates or PCBs.

Several methods of attachment can be used such as gluing or gluing with conducting epoxy. The present applicant has discovered that it is possible to solder the ceramic pellets into place, and that this can give a very strong joint with good electrical and radio-frequency properties. In production, the microstrip will have been already screen-printed with solder paste before the pick-and-place machine positions the ceramic pellet onto the dielectric substrate or PCB. The substrate or PCB with ceramic pellet attached is then passed into a reflow oven that melts the solder, thereby soldering the ceramic resonator in place. This is a procedure ideally suited to modern automated electronic assembly production lines.

Solder will not generally adhere directly to ceramic materials, so the ceramic pellets are advantageously first metallised. Several metals can be used for this and can be deposited in different ways, but the present applicant has found that conductive silver paint is a particularly efficient and cost effective solution for preferred dielectric antenna products. A screen-printing process can easily apply the paint. In some cases (i.e. for some types of paint and for some ceramics) the paint can be allowed to dry, but usually it is preferable for the painted ceramic to be fired in an oven or on a hot plate to ensure good adhesion and a surface that has a low loss at radio frequencies.

With direct microstrip feeding it is often advantageous to have the ceramic pellet substantially offset from the microstrip, as this gives unproved gain, bandwidth and match to 50 ohms (an industry standard impedance in antenna design). However, with such an offset the joint is not strong mechanically because the ceramic pellet is balanced on the microstrip line (see FIG. 1). The mechanical strength of the joint can be improved by the insertion or formation of electrically conductive (e.g. metal or metallic) pads, preferably by way of soldering, under corner or edge portions of the ceramic pellet (see FIG. 2). It has been found that the pads may be extended to form a continuous support (see FIG. 3) without impairing the performance of the dielectric antenna formed thereby. Indeed, in many cases this technique may advantageously be used to improve the performance of the antenna.

In general, metallisation of parts of the lower surface of a dielectric pellet (e.g. a ceramic pellet) and/or the substrate or PCB surface beneath the resonator will cause a concentrating effect on the electric field inside the dielectric, thereby changing the electrical performance of the antenna. The effect of metallisation can even cause the antenna to resonate in a different mode with a consequently larger change in the electrical performance. The shape and extent of the microstrip line feeding the dielectric antenna also affects the overall performance. With careful design, these changes can be used to improve the antenna performance. Whilst it is usual for the metallisation on the two surfaces (underside of dielectric/pellet and substrate/PCB) to be matched with each other, the present applicant has found a few cases where improved antenna performance can be obtained with the metallisations being non-matching.

The present applicant has successfully created DRAs and HDAs with rectangular ceramic pellets acting as dielectric resonators and also with half-split cylindrical ceramic pellets in this way. By extension, all or most other shapes of dielectric pellet (such as those mentioned in the introductory part of the present application) may therefore be attached to a dielectric substrate/microstrip transmission line assembly in this manner.

To form a DLA in accordance with embodiments of the present invention, a conductive microstrip feedline is printed or otherwise provided on a first surface of a dielectric substrate such as a PCB and a second surface of the dielectric substrate or PCB, opposed to the first surface, is metallised over a predetermined portion thereof, leaving at least one area of the second surface free of metallisation. A dielectric pellet is then mounted on top of the microstrip feedline on the first surface or otherwise mounted on the first surface so as to be directly contacted by the microstrip feedline. The dielectric pellet serves to lower an operating frequency of the DLA by making the feedline behave as is it were longer in length and may also improve match of impedance or other properties, but it will be appreciated that in a DLA of the present invention, it is the feedline that serves as the primary radiator (as opposed to the dielectric pellet in a DRA or HDA).

The dielectric pellet is advantageously mounted on an area of the first surface corresponding to the at least one area of the second surface that is not metallised. The microstrip feedline may pass underneath the dielectric pellet, or may be fed up a side surface or wall of the pellet, or may be fed onto a top surface of the pellet. It is generally preferred, when constructing a DLA of embodiments of the present invention, that the microstrip feedline terminates at the dielectric pellet. It is also preferred that the microstrip feedline extends along the first surface of the dielectric substrate from a feed or connection point to the dielectric pellet, and that the second surface of the dielectric substrate is metallised over the full longitudinal extent of the microstrip feedline on the first side except where the feedline contacts the dielectric pellet. A full width of the second surface of the dielectric substrate may be metallised, or only a partial width of the second surface, provided that the partial width is wider than a width of the feedline. In some embodiments, at least one surface of the dielectric pellet, for example an exposed end surface facing away from the feed or connection point, is also metallised, with the feedline being connected to the metallised surface so as to form a "fat" monopole.

The dielectric pellet in DLA applications may also be metallised or soldered as previously described in relation to DRAs and HDAs, and may also be provided with pads as hereinbefore described.

When using a direct connection (e.g. a direct microstrip connection) to feed a DRA or HDA; the present applicant has found that the position of the dielectric material (the dielectric pellet) relative to the direct connection (e.g. a microstrip) influences the direction of a resultant radiation beam. Where a dielectric material of appropriate shape is placed centrally on top of a microstrip transmission line, the dielectric material will tend to generate a beam in a vertical direction. When the dielectric material is placed on top of the microstrip line with a greater volume of the material to the right or left of the microstrip line, a beam having respectively a rightward or leftward component is generated. This technique may be used to help aim a radiation beam in a desired direction and/or to broaden a radiation beam by using a plurality of dielectric resonators positioned in different ways on the microstrip transmission line.

Accordingly, there may be provided one or more dielectric resonators mounted on a microstrip transmission line, wherein at least one of the dielectric resonators is positioned off-centre on the microstrip transmission line.

There may also be provided a method of feeding a DRA or HDA or an array thereof, wherein at least one dielectric resonator is positioned off-centre on the microstrip transmission line in a predetermined direction so as to generate a beam having a directional component in the predetermined direction.

According to a third aspect of the present invention, there is provided an array of dielectric antennas each comprising a dielectric resonator mounted on a microstrip transmission line, wherein at least one of the dielectric resonators is positioned off-centre on the microstrip transmission line.

According to a fourth aspect of the present invention, there is provided a method of feeding a dielectric resonator of a dielectric antenna, wherein the dielectric resonator is positioned off-centre on the microstrip transmission line in a predetermined direction so as to generate a beam having a directional component in the predetermined direction.

FIG. 1 shows side and plan views of a rectangular metallised ceramic resonator pellet 1 soldered onto a direct microstrip transmission line 2 formed on one side of a PCB 3. A conductive ground plane (not shown) may be formed on an opposed side of the PCB 3. The pellet 1 is mounted off-centre, and the soldered joint has good electrical contact but poor mechanical strength.

Figure 2:
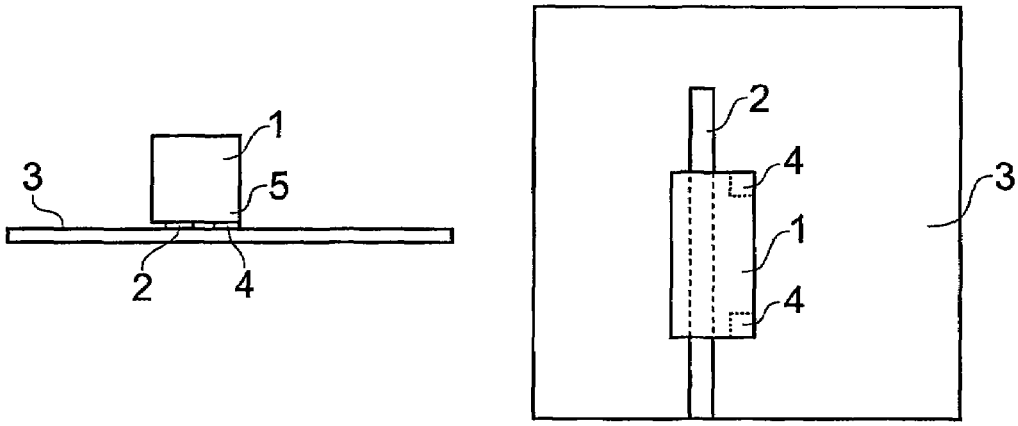
FIG. 2 shows side and plan views of a rectangular ceramic pellet mounted on a direct microstrip transmission line on one side of a PCB with additional support pads printed on the PCB.

FIG. 2 shows side and plan views of a rectangular metallised ceramic resonator pellet 1 soldered onto a direct microstrip transmission line 2 formed on one side of a PCB 3 as in FIG. 1. Additional conductive pads 4 are printed on the PCB 3 so as to support corner portions 5 of the pellet 1, thereby increasing the mechanical strength of the assembly.

Figure 3:
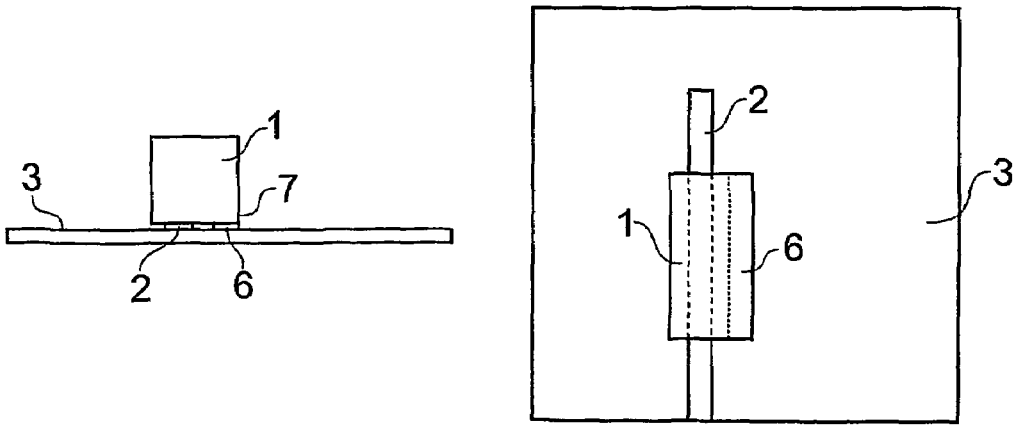
FIG. 3 shows side and plan views of a rectangular ceramic pellet mounted on a direct microstrip transmission line on one side of a PCB with a continuous support strip printed on the PCB.

FIG. 3 shows side and plan views of a rectangular metallised ceramic resonator pellet 1 soldered onto a direct microstrip transmission line 2 formed on one side of a PCB 3 as in FIGS. 1 and 2. An additional conductive strip 6 is printed on the PCB 3 so as to support an edge portion 7 of the pellet 1, thereby forming a single continuous support that increases the mechanical strength of the assembly.

Ceramic materials with relative permittivities ranging from 37 to 134 have been successfully used as resonator pellets 1 fed directly by microstrip transmission lines 2. Specific paints suitable for metallisation of the pellets 1 vary according to the type of ceramic material. Examples of suitable metallic paints include DuPont® 8032 and 5434I, which may be used with Solderplus® 42NCLR-A solder paste.

Generally the benefits that can be obtained by metallising parts of the undersurface of the pellets are improved bandwidth and lower resonant frequency (resulting in a smaller antenna for a given operating frequency).

The return loss bandwidth of an antenna is dependent upon:

The resonant mode of the antenna

The characteristic impedance of the antenna

The feed impedance

The matching circuit

The return loss at which the match is measured.

Figure 4:
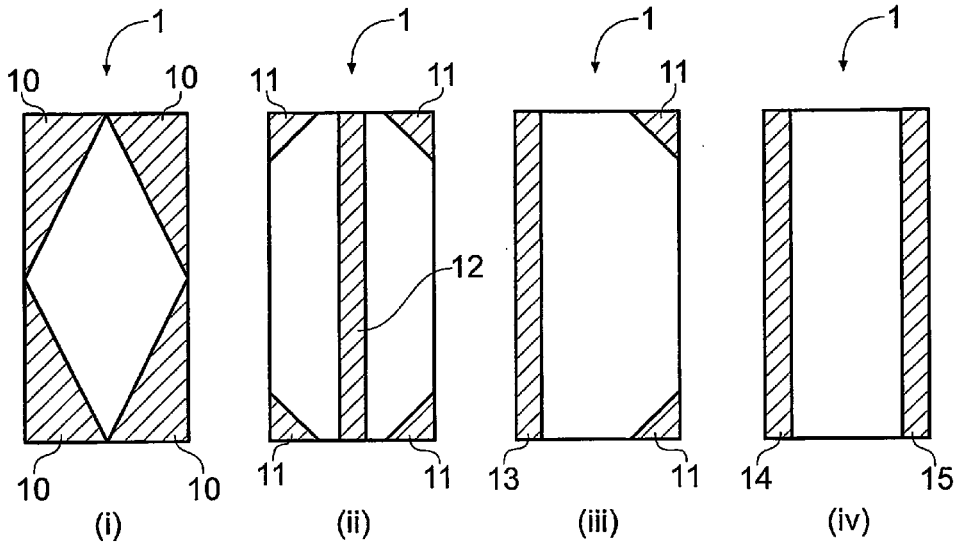
FIG. 4 shows various metallisation patterns on an underside of a dielectric pellet.

In effect, metallisation used to improve the soldered joint can affect the first three items on the list above. Examples where metallisation of a rectangular pellet for solder purposes have resulted in an increase in bandwidth and reduced frequency without adversely affecting the other properties of the antenna are shown in FIG. 4. The shaded areas indicate the metallised areas.

Specifically, FIG. 4(*i*) shows an underside of a rectangular dielectric pellet 1 in which large corner portions 10 are metallised, leaving a rhombus of unmetallised surface in a central part of the underside of the pellet 1.

FIG. 4(ii) shows an underside of a rectangular dielectric pellet 1 in which small corner portions 11 are metallised, as is a central strip 12 along a central longitudinal axis of the underside of the pellet 1.

FIG. 4(iii) shows an underside of a rectangular dielectric pellet 1 in which two small corner portions 11 are metallised on a right hand side of the underside, as is a strip 13 along a left hand side of the underside.

FIG. 4(iv) shows an underside of a rectangular dielectric pellet 1 on which two metallised strips 14 and 15 are provided, one along each of the left and right hand longitudinal sides of the underside.

Figure 5:
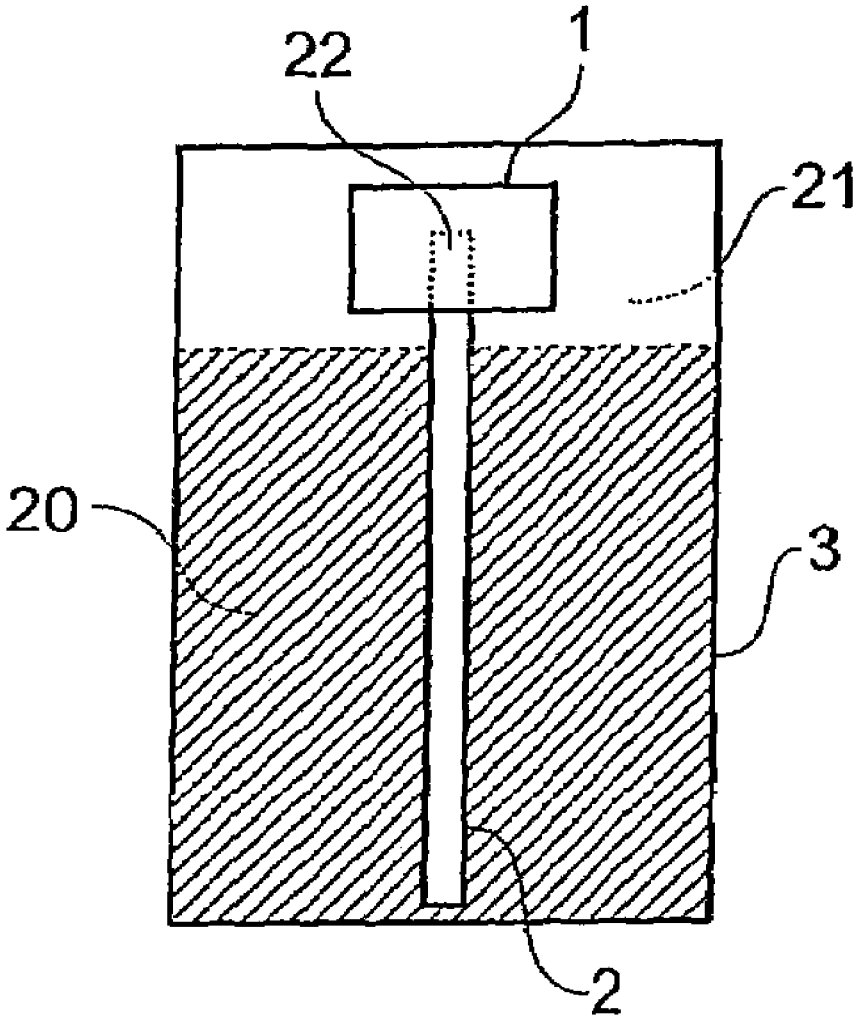
FIG. 5 shows a DLA of an embodiment of the present invention.

FIG. 5 shows a monopole DLA comprised as a dielectric substrate in the form of a PCB 3 having an upper surface on which is printed a microstrip feedline 2 extending longitudinally along the upper surface. A lower surface of the PCB 3 is metaillised 20 underneath the extent of the feedline 2, except for an unmetallised portion 21 underneath an end 22 of the feedline 2. A dielectric ceramic pellet 1 is mounted in direct contact with the feedline 2 on the upper surface of the PCB 3 over the unmetallised portion 21 of the lower surface of the PCB. In operation, it is the end 22 of the feedline that acts as the primary radiator.

Figure 6:
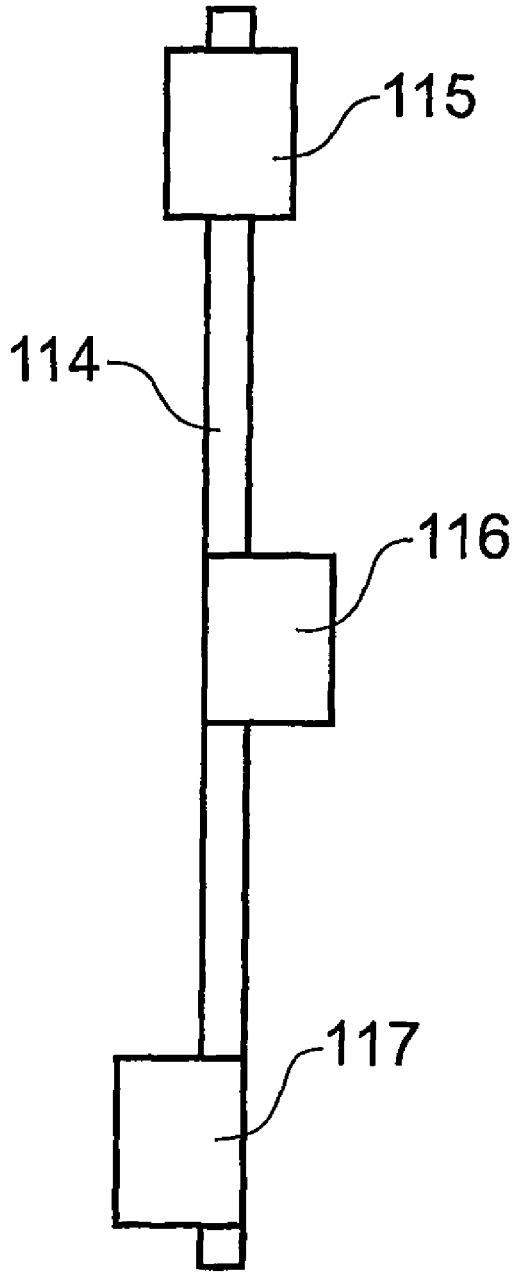
FIG. 6 shows a direct microstrip feed network with an array of dielectric resonators located thereon.

FIG. 6 shows a direct microstrip feed network comprising a microstrip transmission line 114 with three dielectric resonators 115, 116 and 117 mounted thereon. Resonator 115 is mounted centrally on the microstrip 114 and radiates vertically (out of the plane of the drawing towards the viewer). Resonator 116 is mounted to the left of the microstrip 114 and radiates out of the drawing with a leftward component. Resonator 117 is mounted to the right of the microstrip 114 and radiates out of the drawing with a rightward component.

The preferred features of the invention are applicable to all aspects of the invention and maybe used in any possible combination.

Throughout the description and claims of this specification, the words "comprise" and "contain" and variations of the words, for example "comprising" and "comprises", mean "including but not limited to", and are not intended to (and do not) exclude other components, integers, moieties, additives or steps.

The invention claimed is:

1. A dielectric antenna comprising a dielectric pellet mounted in direct contact with a microstrip transmission line formed on one side of a dielectric substrate, wherein the dielectric pellet is configured as a radiator of electromagnetic radiation, wherein the microstrip transmission line has a height, and wherein at least one electrically conductive pad is formed or provided between the substrate and the pellet so as to provide structural stability, the pad having a height matched to the height of the microstrip transmission line.

2. An antenna as claimed in claim 1, wherein the at least one pad is formed or provided at edge or corner portions of a surface of the pellet facing the substrate.

3. An antenna as claimed in claim 1, wherein the at least one pad is soldered to the substrate and/or the pellet.

4. An antenna as claimed in claim 1, wherein the dielectric substrate is a printed circuit board.

5. An antenna as claimed claim 1, wherein the dielectric pellet is made of a ceramics material.

6. An antenna as claimed in claim 1, wherein the dielectric pellet is glued to the transmission line.

7. An antenna as claimed in claim 6, wherein the dielectric pellet is glued to the transmission line with a conducting epoxy.

8. An antenna as claimed in claim 1, wherein the pellet is soldered to the transmission line.

9. An antenna as claimed in claim 1, wherein at least a part of the pellet that contacts the transmission line is metallised.

10. An antenna as claimed in claim 9, wherein the part of the pellet is coated with a conductive silver paint.

11. An antenna as claimed in claim 1, wherein the pellet is mounted substantially centrally on the transmission line with reference to a longitudinal extent of the transmission line.

12. An antenna as claimed in claim 1, wherein the pellet is mounted in an offset position on the transmission line with reference to a longitudinal extent of the transmission line.

13. An antenna as claimed in claim 1, wherein there is provided a plurality of pellets mounted on the transmission line, and wherein at least one of the pellets is mounted in an offset position of the transmission line with reference to a longitudinal extent of the transmission line.

14. An antenna as claimed in claim 1, wherein at least part of a side of the substrate, opposed to that on which the pellet is mounted, is metallised.

15. An antenna as claimed in claim 1, wherein the antenna is a dielectric resonator antenna.

16. An antenna as claimed in claim 1, wherein the antenna is a high dielectric antenna.

17. An antenna as claimed in claim 1, wherein the antenna is a dielectrically-loaded antenna.

18. An antenna as claimed in claim 17, wherein a side of the substrate opposed to that on which the pellet is mounted is metallised, except for an area corresponding to a location of an end of the transmission line on the said one side of the substrate, and wherein the pellet is mounted so as to contact the end of the transmission line.

19. An antenna as claimed in claim 18, wherein the end of the transmission line contacts an underside surface of the pellet.

20. An antenna as claimed in claim 18, wherein the end of the transmission line contacts a side or top surface of the pellet.

21. An antenna as claimed in claim 20, wherein the side or top surface of the pellet is metallised.

22. A dielectrically-loaded antenna comprising a dielectric pellet mounted in direct contact with a microstrip transmission line formed on one side of a dielectric substrate, wherein a side of the substrate opposed to that on which the pellet is mounted is metallised, except for an area corresponding to a location of an end of the transmission line on the said one side of the substrate, and wherein the pellet is mounted so as to contact the end of the transmission line.

23. An antenna as claimed in claim 22, wherein the end of the transmission line contacts an underside surface of the pellet.

24. An antenna as claimed in claim 22, wherein the end of the transmission line contacts a side or top surface of the pellet.

25. An antenna as claimed in claim 24, wherein the side or top surface of the pellet is metallised.

* * * * *